US006926504B2

(12) United States Patent
Howard

(10) Patent No.: US 6,926,504 B2
(45) Date of Patent: Aug. 9, 2005

(54) SUBMERSIBLE ELECTRIC PUMP

(75) Inventor: William F. Howard, West Columbia, TX (US)

(73) Assignees: Total Fiza Elf, Pau Cedex (FR); Eni S.p.A., Milanese (IT); Shell International Exploration & Production B.V., The Hauge (NL)

( * ) Notice: Subject to any disclaimer, the term of this patent is extended or adjusted under 35 U.S.C. 154(b) by 0 days.

(21) Appl. No.: 10/180,720

(22) Filed: Jun. 26, 2002

(65) Prior Publication Data

US 2002/0197174 A1 Dec. 26, 2002

Related U.S. Application Data

(60) Provisional application No. 60/301,332, filed on Jun. 26, 2001.

(51) Int. Cl.[7] ..... F04B 35/04

(52) U.S. Cl. ..... 417/417; 166/66.4; 417/555.2

(58) Field of Search ..... 417/417, 569, 417/360, 415, 423.3, 448, 416, 555.2, 554; 166/66.4, 66.6, 66; 318/135; 310/15

(56) References Cited

U.S. PATENT DOCUMENTS

| | | | | | |
|---|---|---|---|---|---|
| 2,292,796 | A | * | 8/1942 | Pyle | 166/105.5 |
| 4,538,970 | A | * | 9/1985 | Rabson | 417/417 |
| 4,548,552 | A | | 10/1985 | Holm | 417/417 |
| 4,562,385 | A | * | 12/1985 | Rabson | 318/135 |
| 4,687,054 | A | | 8/1987 | Russell et al. | 166/66.4 |
| 4,815,949 | A | | 3/1989 | Rabson | 417/417 |
| 5,049,046 | A | * | 9/1991 | Escue et al. | 417/411 |
| 5,193,985 | A | * | 3/1993 | Escue et al. | 417/53 |
| 5,252,043 | A | | 10/1993 | Bolding et al. | 417/417 |
| 5,620,048 | A | * | 4/1997 | Beauquin | 166/66.4 |
| 5,657,821 | A | | 8/1997 | Beauquin et al. | |
| 5,734,209 | A | | 3/1998 | Hallidy | 310/12 |
| 5,831,353 | A | | 11/1998 | Bolding et al. | 310/12 |
| 5,960,875 | A | * | 10/1999 | Beauquin et al. | 166/66.4 |
| 6,138,763 | A | | 10/2000 | Beauquin | |
| 6,176,308 | B1 | | 1/2001 | Pearson | 166/65.1 |
| 6,203,288 | B1 | | 3/2001 | Kottke | 417/328 |
| 6,250,384 | B1 | | 6/2001 | Beauquin | |
| 6,283,720 | B1 | | 9/2001 | Kottke | 417/55 |
| 6,288,470 | B1 | | 9/2001 | Breit | 310/254 |
| 6,289,575 | B1 | | 9/2001 | Hollingsworth et al. | 29/596 |
| 6,508,308 | B1 | | 1/2003 | Shaw | 166/313 |
| 2002/0079763 | A1 | | 6/2002 | Fleshman et al. | 310/87 |
| 2002/0189805 | A1 | | 12/2002 | Howard | |

OTHER PUBLICATIONS

Howard, William F., U.S. Appl. No. 10/167,622, filed Jun. 12 2002, Entitled: Double–Acting Reciprocating Downhole Pump.

* cited by examiner

*Primary Examiner*—Michael Koczo, Jr.
(74) *Attorney, Agent, or Firm*—Moser Patterson & Sheridan LLP

(57) ABSTRACT

An improved electrical pump is first provided for use in a wellbore. The pump comprises a stator and a stator housing, and an armature and an armature housing. The stator housing and the armature housing define concentrically nested tubular bodies. The armature housing is configured to permit production fluids to flow therethrough. In one aspect, the stator and armature are assembled in connectible and interchangeable sections called "modules" that can be attached in series. In one aspect, the electrical operation of coils within the stator is protected from individual coil short-circuiting or failure by wiring them in parallel, rather than in series. In addition, each module may be wired in parallel. In this way, a failure of one stator module will not result in the failure of another stator module. In an embodiment of the present invention, the valves of the pump are capable of being retrieved by a wireline, without pulling the entire production string. A method for using a plurality of electrical pumps is also provided. The configuration of the electrical pumps allows multiple linear pumps to be placed in series with the production tubular member. Alternatively, a rotary pump design is provided which allows multiple rotary pumps to be placed in series with the production tubular member.

36 Claims, 9 Drawing Sheets

SUBMERSIBLE ELECTRIC PUMP

CROSS-REFERENCE TO RELATED APPLICATIONS

This application claims priority to a pending provisional patent application entitled "Submersible Electrical Pump, and Method for Using Plurality of Submersible Electrical Pumps for Well Completion." That provisional application was filed on Jun. 26, 2001, and was assigned Ser. No. Prov. 60/301,332.

BACKGROUND OF THE INVENTION

1. Field of the Invention

This invention relates to pumping apparatus for transporting fluids from a well formation to the earth's surface. More particularly, embodiments of the invention pertain to an improved electrical pump comprising a downhole linear electric motor and a positive displacement pump assembly. In addition, embodiments of the invention relate to the use of a plurality of submersible electrical pumps in the completion or operation of a well.

2. Description of the Related Art

Many hydrocarbon wells are unable to produce at commercially viable levels without assistance in lifting formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation, thereby inhibiting the unassisted flow of production fluid to the surface.

A common approach for urging production fluids to the surface includes the use of a mechanically actuated, positive displacement pump. Mechanically actuated pumps are sometimes referred to as "sucker rod" pumps. The reason is that reciprocal movement of the pump necessary for positive displacement is induced through reciprocal movement of a string of sucker rods above the pump from the surface.

A sucker rod pumping installation consists of a positive displacement pump disposed within the lower portion of the production tubing. The installation includes a piston which is moved in linear translation within the tubing by means of steel or fiberglass sucker rods. Linear movement of the sucker rods is typically imparted from the surface by a rocker-type structure. The rocker-type structure serves to-alternately raise and lower the sucker rods, thereby imparting reciprocating movement to the piston within the pump downhole.

Certain difficulties are experienced in connection with the use of sucker rods. The primary problem is rooted in the fact that most wells are not truly straight, but tend to deviate in various directions en route to the zone of production. This is particularly true with respect to wells which are directionally drilled. In this instance, deviation is intentional. Deviations in the direction of a downhole well cause friction to occur between the sucker rod joints and the production tubing. This, in turn, causes wear on the sucker rod and the tubing, necessitating the costly replacement of both. Further, the friction between the sucker rod and the tubing wastes energy and requires the use of higher capacity motors at the surface.

To overcome this problem, submersible electrical pumps have been developed. These pumps are installed into the well itself, typically at the lower end of the production tubing. State of the art submersible electrical pumps comprise a tubular assembly which resides at the base of the production string. The pump includes a rotary electric motor which turns turbines at a high horsepower. These turbines are placed below the producing zone of a well and act as fans for forcing production fluids upward through the wellbore.

Efforts have been made to develop a linear electric motor for use downhole. One example is U.S. Pat. No. 5,252,043, issued to Bolding, et al., entitled "Linear Motor-Pump Assembly and Method of Using Same." Other examples include U.S. Pat. No. 4,687,054, issued in 1987 to Russell, et al. entitled "Linear Electric Motor For Downhole Use," and U.S. Pat. No. 5,620,048, issued in 1997, and entitled "Oil-Well Installation Fitted With A Bottom-Well Electric Pump." In these examples, the pump includes a linear electric motor having a series of windings which act upon an armature. The pump is powered by an electric cable extending from the surface to the bottom of the well, and residing in the annular space between the tubing and the casing. The power supply generates a magnetic field within the coils which, in turn, imparts an oscillating field upon the armature. In the case of a linear electric motor, the armature is translated in an up-and-down fashion within the well. The armature, in turn, imparts translational movement to the pump piston residing below the motor. The piston enables a positive displacement pump to displace fluids up the wellbore and to the surface with each stroke of the piston.

Submersible pump assemblies which utilize a linear electric motor have not been introduced to the oil field in commercially significant quantities. Such pumps would suffer from several challenges, if employed. A first problem relates to the introduction of the submersible pump into the wellbore. As noted, wellbores tend to have inherent deviations. At the same time, submersible pumps can be of such a length that it becomes difficult for the pump to negotiate turns and bends within the tubing string of the well. The length of a linear submersible pump is generally proportional to the horsepower desired to be generated by the pump assembly. Greater horsepower would be needed for deeper wells in order to overcome the prevailing hydrostatic head. This, in turn, would require a greater length or number of windings within the stator and corresponding armature.

Overriding this concern is the expense of manufacturing and stocking submersible pumps of various sizes. In this respect, the size of the electric motor is not standard, but is dependent upon the individual needs of each well and the amount of power, force and length of stroke desired.

Another problem relates to the inconsistent power sources at wellsites. Working a well necessarily involves the stopping and starting of the motor for more efficient production. Power surges associated with the start of the motor create harmful temperature variations and mechanical stresses which cause wear of the electrical insulators, connections and coils. Further, power sources themselves provide inconsistent electricity flow. Power spikes, interruptions in services, and other causes of uneven power supply generate, by the Joule effect, temperature variations that accelerate aging of electrical components. Considering that voltages acting upon the electrical components may range from 1000 volts to even 3000 volts, significant wear from inconsistent power presents a real source of wear. Hence, a system which provides for redundant electromagnetic coils within a stator for the submersible electrical pump is needed.

Also pertaining to the electrical system of a motor is the problem of line loss within the power cable. Current pumps utilize AC power directed from the surface to the motor. The use of AC power creates the potential for high power loss as electrical current is directed downward, caused by such factors as the inherent resistivities and resonant frequencies within the lines.

An additional problem encountered in submersible electrical pumps is the corrosive effect of the formation fluids themselves. Many rotary pump failures arise from short-circuits which take place in the electrical connection with the downhole motor. Such short-circuits are often due to normal progressive degradation of the electrical insulation barriers around the power cable. Those skilled in the art will appreciate that hydrocarbon wells are drilled for the purpose of exposing oil-bearing formations below an earth surface. Production fluids typically include water, hydrocarbons, acidic gases and other corrosive materials that invade the borehole during production. Such fluids attack the integrity of the electrical components, resulting in failure of the circuitry of the motor.

The circuit arrangement of the submersible pumps themselves exacerbates the problem. Submersible pump designs have been wired with coils or "windings," in series. The result is that if one coil fails, power to the entire electrical assembly fails. Thus, a redundant system of coils, and even of pumps, is desirable.

Still another problem inherent in current submersible pump designs pertains to the restricted diameter for fluid flow within the motor section. In linear submersible pump designs, the motor portion of the pump is configured above the piston and sucker rod pump portion. The result is that fluid being displaced by the pump must travel through restrictive fluid ports which reside within the armature portion of the motor en route to the surface. Typically, the inner diameter of the production string defines an already narrow path of flow through which production fluids must travel. Positioning a linear electric motor within the tubing creates a further restriction for fluid movement. Therefore, a linear electrical pump design which provides for a hollow bore through the armature is desirable. Further, there is a need for such a design where the housing for the stator is in series with the production tubing, rather than residing within the production tubing. In this way, a larger armature and armature bore are provided.

When a submersible pump is in need of repair or replacement, most current pump designs require that the entire production string be pulled. This means that a work-over unit capable of pulling string must be mobilized to the wellsite, oftentimes at remote locations. Further, the time incident to setting up and pulling the string requires a costly cessation of production operations. This challenge is particularly severe in the case of an offshore well.

Pulling the tubing is made more difficult and time consuming because the power cable to the downhole electric motor is tied to the outside of the production tubing. Hence, the cable must be disconnected from the tubing and otherwise manipulated as the tubing string is pulled. Thus, a linear electrical pump design having valves which are wireline retrievable is also needed.

In view of these challenges, it is apparent that an improved submersible electrical pump is desired. In addition, a method of completing a well utilizing a plurality of submersible electrical pumps is needed. In this manner, backup pumps are available in the event one pump fails, or in the event additional pumping capacity is needed downhole.

SUMMARY OF THE INVENTION

An improved electrical pump is first provided for use in a wellbore. The pump is a linear electrical pump that can be placed in series with a tubular string, such as a production tubular. The pump first comprises a stator housing. The stator housing in one arrangement is a tubular body defining an elongated bore therethrough. The stator housing is provided to house a stator. The stator preferably comprises one or more coils, or windings, which provide an oscillating magnetic field for reciprocating an armature. The windings are disposed in a more or less circular arrangement within the stator housing, proximal to the upper end of the housing. In one aspect, the stator is assembled in connectible and interchangeable sections called "modules" that can be attached in series. The use of "modules" allows the pump to be quickly and economically expanded to meet greater power needs.

In one aspect, the electrical operation of the coils is protected from individual coil short-circuiting by arranging for a circuitry which is in parallel, rather than in series. More specifically, each coil is in electrical communication with the power cable through a parallel circuitry rather than an in-series circuitry. In addition, each module may be wired in parallel. In this way, a failure of one stator module will not result in the failure of another stator module.

An improved electrical pump is first provided for use in a wellbore. The pump is a linear electrical pump that can be placed in series with a tubular string, such as a production tubular member. The pump first comprises a stator housing. The stator housing in one arrangement is a tubular body defining an elongated bore therethrough. The stator housing is provided to house a stator. The stator preferably comprises one or more coils, or windings, which provide an oscillating magnetic field for reciprocating an armature. The windings are disposed in a more or less circular arrangement within the stator housing, proximal to the upper end of the housing. In one aspect, the stator is assembled in connectible and interchangeable sections called "modules" that can be attached in series. The use of "modules" allows the pump to be quickly and economically expanded to meet greater power needs.

As with the stator, the armature is preferably comprised of a plurality of modules. The armature modules are capable of being connected end-to-end. In one aspect, the armature modules are interchangeable. In this way, the manufacturer need only manufacture, market and place in inventory a single-size motor product which can be linked with other like products to provide the downhole needs of each individual well.

The electrical pump further comprises a pump inlet and a pump outlet. The pump inlet is connected proximal to the lower end of the stator housing. The pump outlet is connected proximal to the upper end of the armature housing. A "traveling" valve is also provided that reciprocates in response to linear reciprocation of the armature and armature housing. The "traveling" valve" is placed in direct fluid communication with the bore of the armature. In this respect, the piston assembly normally connecting the armature and the traveling valve is removed, allowing both for a shorter pump assembly, and allowing for a hollow armature section. The traveling valve is translated linearly by the armature, allowing the pump to positively displace fluid upwardly through the wellbore.

In an embodiment of the present invention, the armature and the valves of the pump are capable of being retrieved by a wireline or cable, without pulling the entire production string. The stator section remains in the tubing string.

A method of completing a wellbore or otherwise pumping fluids using a plurality of electrical pumps is also provided.

The pumps are in series with the tubing and are set at selected depths. Pump designs are provided herein which allow for either rotary motors or linear motors to be used in the wellbore. A series of submersible electrical pumps may be provided between sections of the production tubing of a well. Multiple linear pumps of the present invention can be placed in series within the production tubing; alternatively, for a rotary pump, a pump housing is provided so that fluid can be diverted around the rotary pump and within the housing so that multiple rotary pumps can be placed in series within the production tubing.

BRIEF DESCRIPTION OF THE DRAWINGS

So that the manner in which the above recited features of the present invention are attained and can be understood in detail, a more particular description of the invention, briefly summarized above, may be had by reference to the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
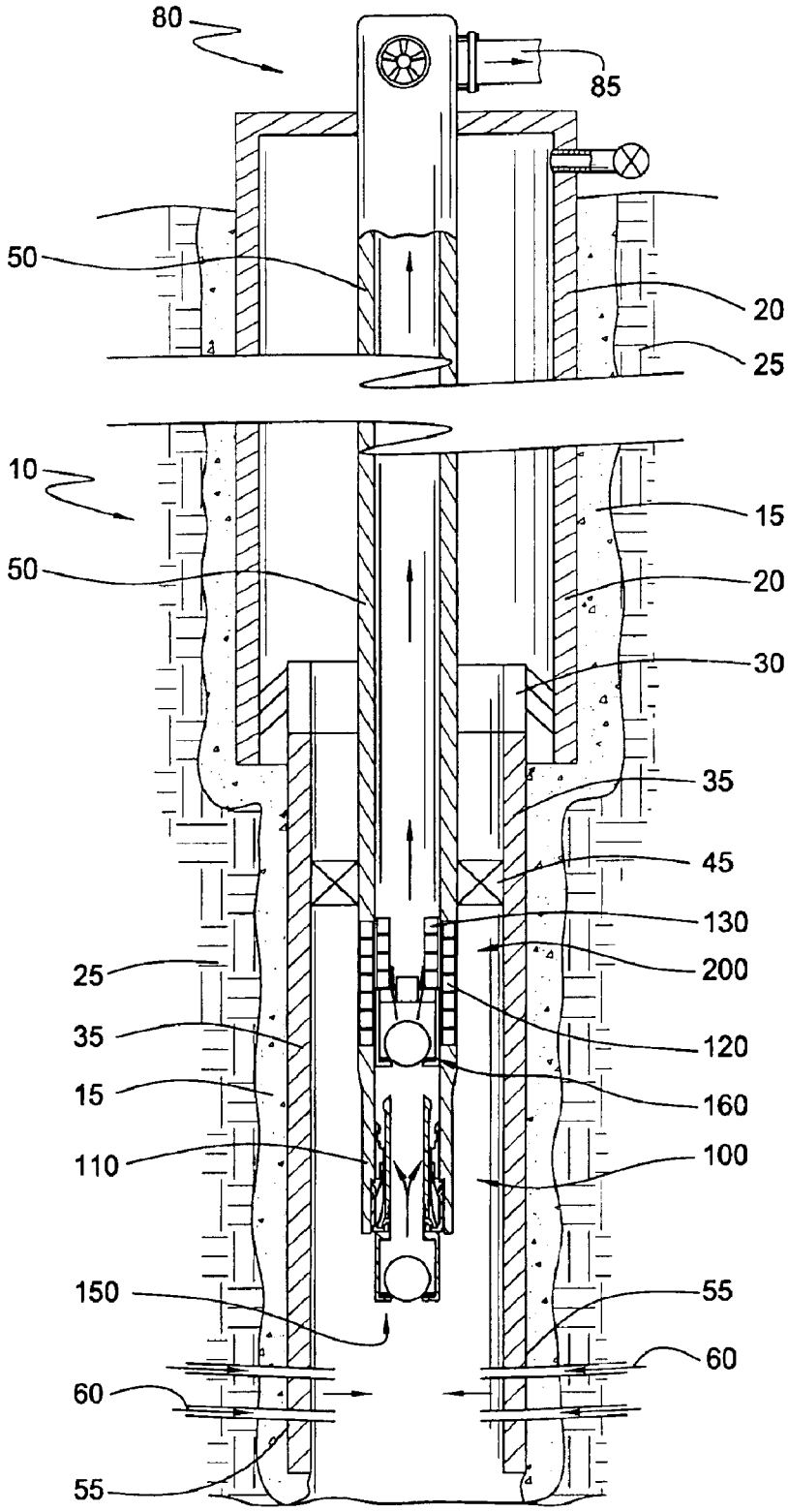
FIG. 1 is a cross-sectional view of a wellbore having a positive displacement pump of the present invention.

FIG. 1 presents a cross-sectional view of a wellbore 10. As completed in FIG. 1, the wellbore 10 has a first string of surface casing 20 hung from the surface. The first string 20 is fixed in a formation 25 by cured cement 15. A second string of casing 35 is also visible in FIG. 1. The second casing string 35, sometimes referred to as a "liner," is hung from the surface casing 20 by a conventional liner hanger 30. The liner hanger 30 employs slips which engage the inner surface of the surface casing 20 to form a frictional connection. The liner 35 is also cemented into the wellbore 10 after being hung from the surface casing 20.

The wellbore 10 is shown in a state of production. First, the liner 35 has been perforated in order to provide fluid communication between the wellbore 10 and a producing zone in the formation 25. Perforations may be seen at 55. Arrows 60 depict the flow of hydrocarbons into the wellbore 10. Second, a string of production tubing 50 is shown. The production tubing 50 provides a path for hydrocarbons to travel to the surface of the wellbore 10. A packer 45 is positioned within the tubing 50 in order to seal the annular region between the tubing 50 and the liner 35. The term "tubing" or "production tubular member" herein includes not only joints of tubing, but any tubular body nested within the casing string and through which production fluids travel en route to the earth surface.

A wellhead 80 is shown at the surface. The wellhead 80 is presented somewhat schematically. The wellhead 80 receives production fluids, and diverts them downstream through a flow line 85. Formation fluids are then separated, treated and refined for commercial use. It is understood that various components of a conventional wellhead and separator facilities are not shown in FIG. 1.

Finally, the wellbore 10 in FIG. 1 includes a submersible electrical pump 100 of the present invention, in a first embodiment. In this view, the pump 100 is being reciprocated via a submersible, linear electrical motor 200. At the stage shown in FIG. 1, the pump 100 is in its upstroke.

Figure 2:
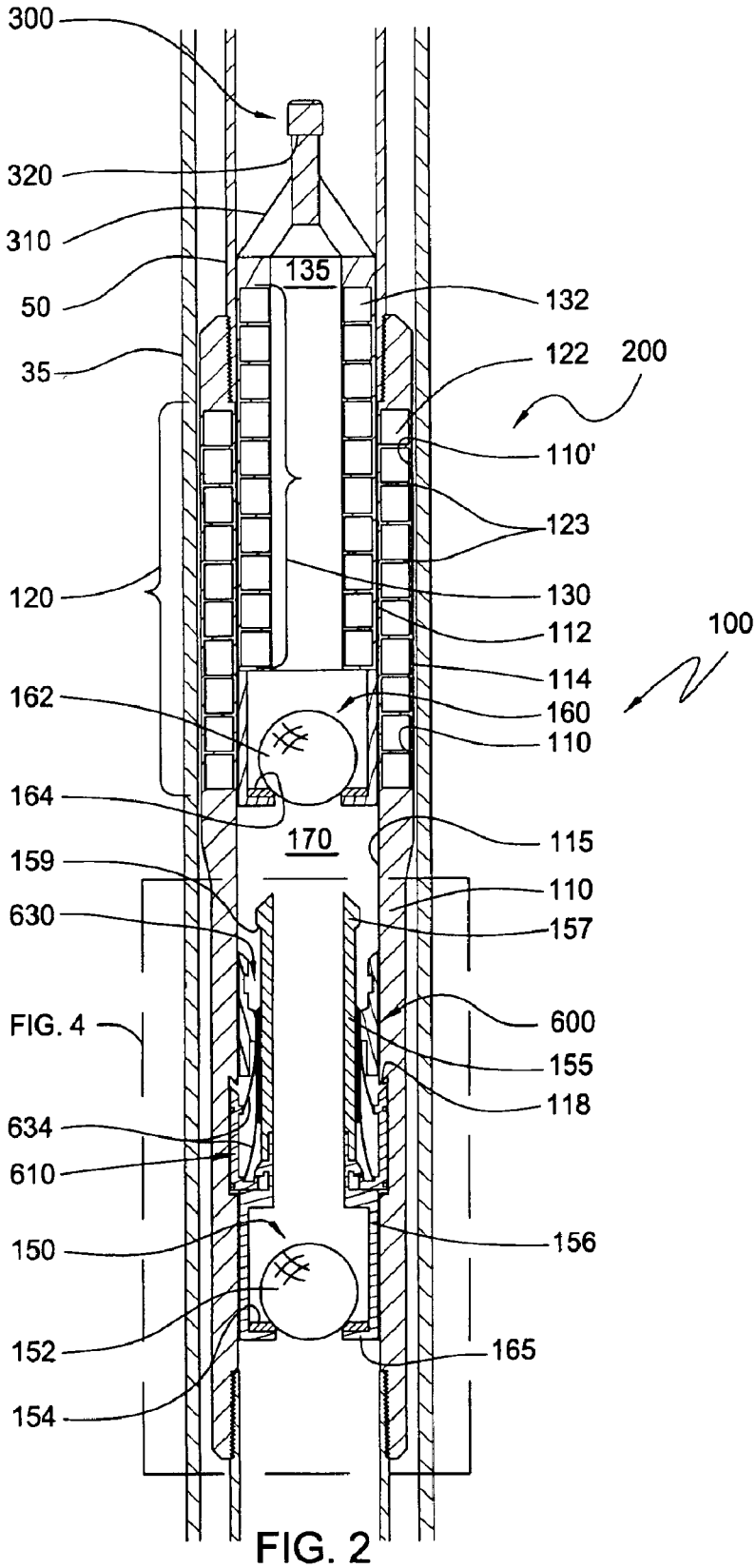
FIG. 2 is a more enlarged cross-sectional view of a positive displacement pump employing a linear electric motor.

The pump 100 of FIG. 1 is shown in greater detail in FIG. 2. FIG. 2 presents a cross-sectional view of a positive displacement pump 100. The pump 100 employs a linear electric motor 200. The pump 100 in FIG. 1 first comprises a stator housing 110. The stator housing 110 has a top end and a bottom end. The top end of the housing 110 is threadedly connected to a joint of production tubing 50. Thus, the stator housing 110 is in series with the production tubing 50. The production tubular 50 and pump 100 are shown located within a string of casing 35 within a wellbore.

The stator housing 110 in one arrangement defines a tubular body having a bore 115 therethrough. However, for purposes of the present application, the term "housing" includes any means of structural support. The stator modules are disposed proximal to the top end of the stator housing 110. A pair of thin metal tubes 112, 114 are concentrically aligned to form the stator housing 110 at the upper end. Thus, in the present invention, the inner tube 112 and the outer tube 114 form the stator housing 110 at the upper end.

The pump 100 of FIG. 1 is shown in greater detail in FIG. 2. FIG. 2 presents a cross-sectional view of a positive displacement pump 100. The pump 100 employs a linear electric motor 200. The pump 100 in FIG. 1 first comprises a stator housing 110. The stator housing 110 has a top end and a bottom end. The top end of the housing 110 is threadedly connected to a joint of production tubing 50. Thus, the stator housing 110 is in series with the production tubing 50. The production tubular member 50 and pump 100 are shown located within a string of casing 35 within a wellbore.

The various stator modules 122 are shown schematically in FIG. 2. It can be seen that a coupling 123 connects the stator modules 122. This provides uniform spacing between the modules 122, and also helps maintain the stator pole pitch in a consistent fashion along the stator 120. Additional details concerning the construction of coils 124 within stator modules 122 is found in U.S. Pat. No. 5,831,353, entitled "Modular Linear Motor and Method of Constructing and Using Same," which is incorporated herein in its entirety by reference.

Figure 3:
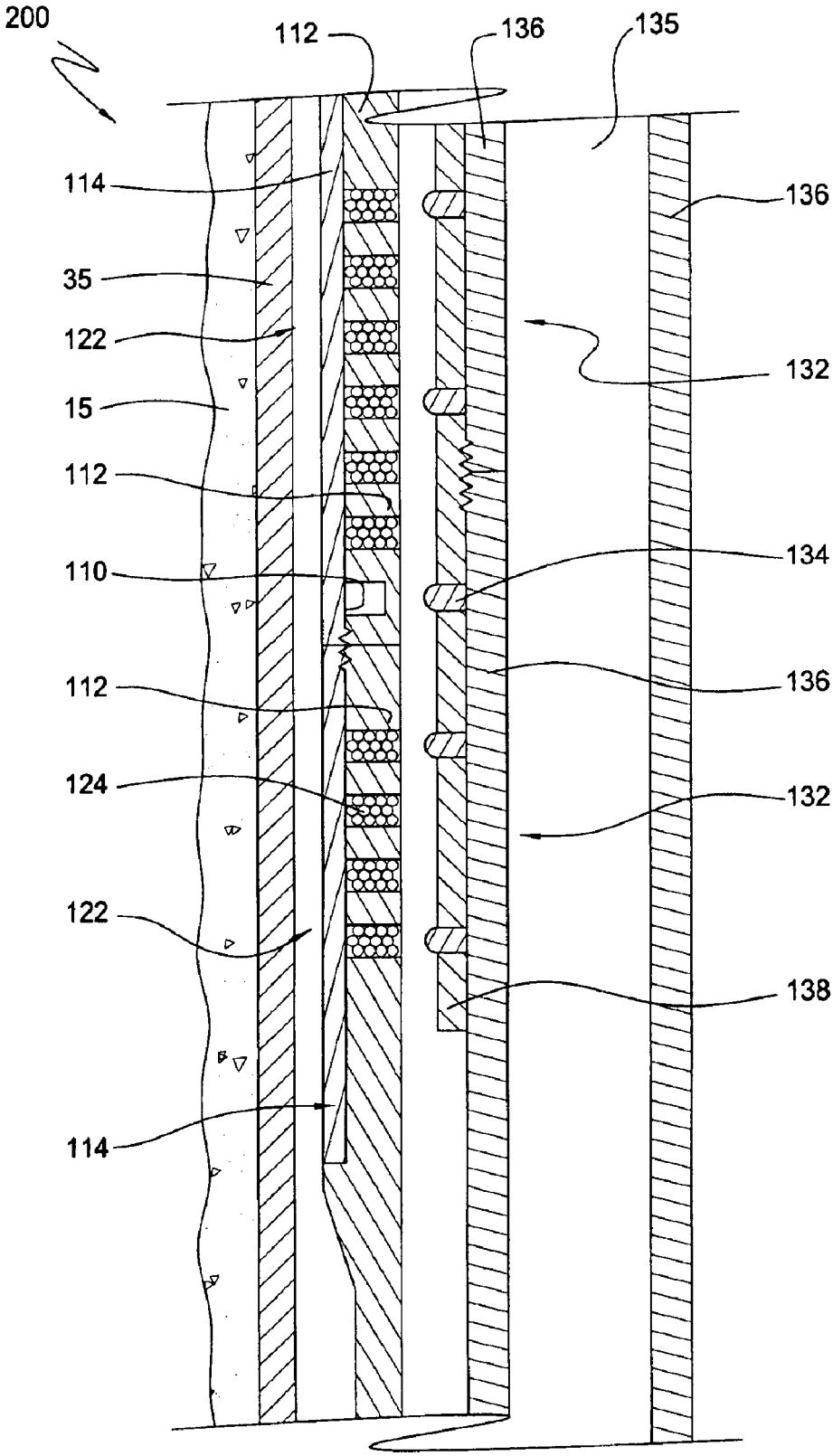
FIG. 3 is yet a more enlarged section view presenting a portion of the motor section of the pump.

FIG. 3 provides an enlarged, cross-sectional view of the motor portion 200 of the pump 100. In this view, the arrangement of two individual stator modules 122 is more clearly shown. It can be seen that the coils 124 are wound around the tubular wall 112, and covered by the outer wall 114.

The coils 124 of the stator modules 122 and an arrangement of module connectors, are electrically connected in a three phase "Y" configuration. The coils 124 respond to a direct current pulse which may be positive, neutral or negative. The polarity in the coils 124 is alternated by a controller (not shown) at the surface in order to switch the polarity of the magnetic fields. By applying the appropriate polarity to each phase of the three phase coils 124, a grouping of toroidal magnetic fields three coils wide and of alternating polarity can be established along the length of each stator module 122. In one aspect, the controller is programmable.

Referring again to FIG. 2, multiple stator modules 122 are mechanically connected, in series. The use of connectible stator modules 122 allows the pump 100 to be quickly and economically expanded to meet greater power needs. Modular construction also enables the motor portion 200 of the pump 100 to be assembled or altered and reassembled in a repair facility or in the field, to meet the production needs of a specific well. It also enables the pump to be more efficiently repaired in a shop or in the field.

Associated with the stator 120 is a corresponding armature 130. Those of ordinary skill in the art will understand that a motor armature 130 typically comprises a set of permanent magnets 134 which respond to an oscillating magnetic field generated by the stator coils 124. The armature 130 is landed within the housing 110 during assembly; or after assembly is complete by using a wireline or coiled tubing insertion method. As with the stator 120, the armature 130 is comprised of a plurality of modules 132 that are mechanically joined end-to-end. Each armature module 132 provides preferably a set of magnets 134 which acts in response to the magnetic force of the stator modules 122. Polarity of the magnets 134 is arranged to cause linear translation of the armature 130 in response to the oscillating magnetic field of the stator 120 and its coils 124.

The magnets 134 are preferably disposed in a more or less circular arrangement within the inner tube 112 of the housing 120. An armature housing 136 connects the magnets 134 within each module 132. A bore 135 is defined within the longitudinal axis of the armature housing 136. The magnets 134 reside along the outer surface of the armature housing 136 and the inner surface of the pump inner tube 112. 122. In one aspect, a non-conductive filler material 138 is bonded between the magnets 134.

A smooth bearing surface is provided on the inner surface of the inner tube 112 of the housing 110 to permit reciprocating movement of the magnets 134 therein. The armature modules 132 reciprocate in response to the magnetic field shifts to maintain polarity alignment. The speed of the armature modules 132 is controlled by the controller (not shown) and is directly proportional to the rate the controller switches the polarity of the magnetic fields. Additional details concerning the construction of the magnets 134 along the armature housing 136 is shown in FIG. 3, and is also found in U.S. Pat. No. 5,831,353, previously referenced and incorporated herein.

As shown in FIG. 2, the stator modules 122 are connected in end-to-end fashion. Likewise, the armature modules 132 are connected end-to-end, and correspond with the stator modules 122. Those of ordinary skill in the art will understand that the overall horsepower of the linear electrical motor is proportional to the length of the motor, which corresponds to the number of stator modules 122 and armature modules 132 employed. This means that greater horsepower can be selectively accomplished in the submersible electrical pump 100 by providing additional stator 122 and armature 132 modules.

Disposed within the stator housing 110 is a pair of valves 150, 160. First, a lower valve 150 is provided at the base of the stator housing 110, and serves as a pump inlet. This valve 150 is a "standing valve" meaning that it does not reciprocate within the wellbore 10. Second, an upper valve 160 is provided at the base of the armature housing 130, and serves as a pump outlet. This valve is a "traveling valve," meaning that it does reciprocate. The traveling valve 160 is translated linearly by the armature 130, allowing the pump 100 to positively displace fluid upwardly through the wellbore 10. The upper "traveling" valve 160 is placed in direct fluid communication with the inner bore 135 of the armature housing 136. This allows fluid to travel directly from the outlet valve 160 through the armature 130 and up the tubing 50.

Oscillation of the armature 130 creates linear translation of the traveling valve 160. In the preferred embodiment, the traveling valve 160 is a check valve, i.e., one-way valve, comprising a ball 162 and seat 164. Similarly, the standing valve is preferably a check valve comprising a ball 152 and seat 154. However, the present invention will allow for other types of valves to be used.

The area defined by the stator housing 110, the lower (standing) valve 150, and the upper (traveling) valve 160 is a pump chamber 170. It is the purpose of the pump chamber 170 to serve as a path of fluid transfer during the pumping operation. In operation, the armature 130 imparts a reciprocating upstroke and down stroke to the traveling valve 160. During the upstroke, the traveling valve 160 is closed. In this respect, the upper ball 162 is seated upon the upper seat 164. Movement of the closed traveling valve 160 upward creates a vacuum within the pump chamber 170. This, in turn, causes the standing valve 150 to unseat so that the lower ball 152 lifts off of the lower seat 154. Production fluids are then drawn upward into the chamber 170.

On its down stroke, the bottom valve 150 closes. This means that the standing ball 152 seats upon the lower seat 154, primarily with the aid of gravity. At the same time, the traveling valve 160 opens in order to receive fluids previously residing in the chamber 170. Fluids are delivered by positive displacement through the armature bore 135 and up the wellbore 10 through the tubing 50. The upstroke and down stroke cycles are repeated, causing fluids to be lifted upward through the wellbore 10 and, ultimately, to the earth's surface.

As noted, the traveling valve 160 is connected to the armature 130, and is in fluid communication with the armature bore 135. Production fluids are thus able to flow directly from the chamber 170 of the pump 100 and through the bore 135 of the armature 130 without being circuitously diverted around a piston. Conventional armature designs, such as that shown in U.S. Pat. No. 4,687,054, include a piston at the base of the motor. Removal of the piston allows for a greater volume of production fluids to flow through the linear motor portion of the pump. It also allows for the armature 130 of the motor 200 to be connected to the traveling valve 160 of the pump, either directly or via a tubular connector (such as a lower extension of the armature housing). In this manner, the piston typically employed in a submersible linear electrical pump design is removed and the overall pump assembly is shortened.

The preferred arrangement is to locate the standing valve below the stator, and to locate the traveling valve below the armature. This is shown best in FIG. 2. This arrangement minimizes the required suction pressure of the pump 200. It also minimizes the volume between the standing 150 and traveling 160 valves. This, in turn, improves the pump 200 performance whenever a significant portion of the fluid is in a gas phase. However, the invention allows the possibility of locating either or both valves 150, 160 at other locations in the flow path of the fluid. For example, the standing valve may be connected directly or indirectly to the stator, and the traveling valve may be connected directly or indirectly to the armature. It is also possible, for instance, to locate the standing valve above the traveling valve. Therefore, the scope of the present invention is not limited to the location of the traveling and standing valves.

The most common source of failure for sucker rod pumps is in the valves themselves. Those skilled in the art will understand that downhole conditions are harsh for mechanical parts. Temperatures downhole are high. Further, production fluids contain corrosive elements such as sulfuric acid. At the same time, sand and other aggregates from the formation can become suspended in production fluids which have an erosive effect upon mechanical parts. Therefore, the present invention provides for an optional fishing neck 300. The fishing neck 300 allows the armature 130 and the connected traveling valve 160 of the pump 100 to be retrieved and repaired without the necessity of pulling the entire production string 50 or the stator 120 and stator housing 110.

The fishing neck 300 is suspended above the armature 130 by a cage 310. The cage 310 allows production fluids to travel around the fishing neck 300 en route to the surface. The fishing neck 300 is configured to receive an overshot wireline tool (not shown). The fishing neck 300 has shoulders 320 which land on upsets in the overshot tool. In this manner, the armature 130 and traveling valve 160 of the pump 100 can be retrieved.

In the preferred embodiment, the standing valve 150 of the submersible electrical pump 100 is separately retrievable. The standing valve 150 resides within an inlet port housing 156 connected to the lower end of the stator housing 110. The inlet port housing 156 has a vertical tubular member 155 that extends upward into the pump chamber 170. The vertical tubular member 155 includes a fishing neck 157 having an upset surface 159. The fishing neck 157 is designed to be received within a running tool (not shown). Those of ordinary skill in the art will perceive that the running tool will need to have an overshot in order to radially catch the fishing neck 157.

Figure 4:
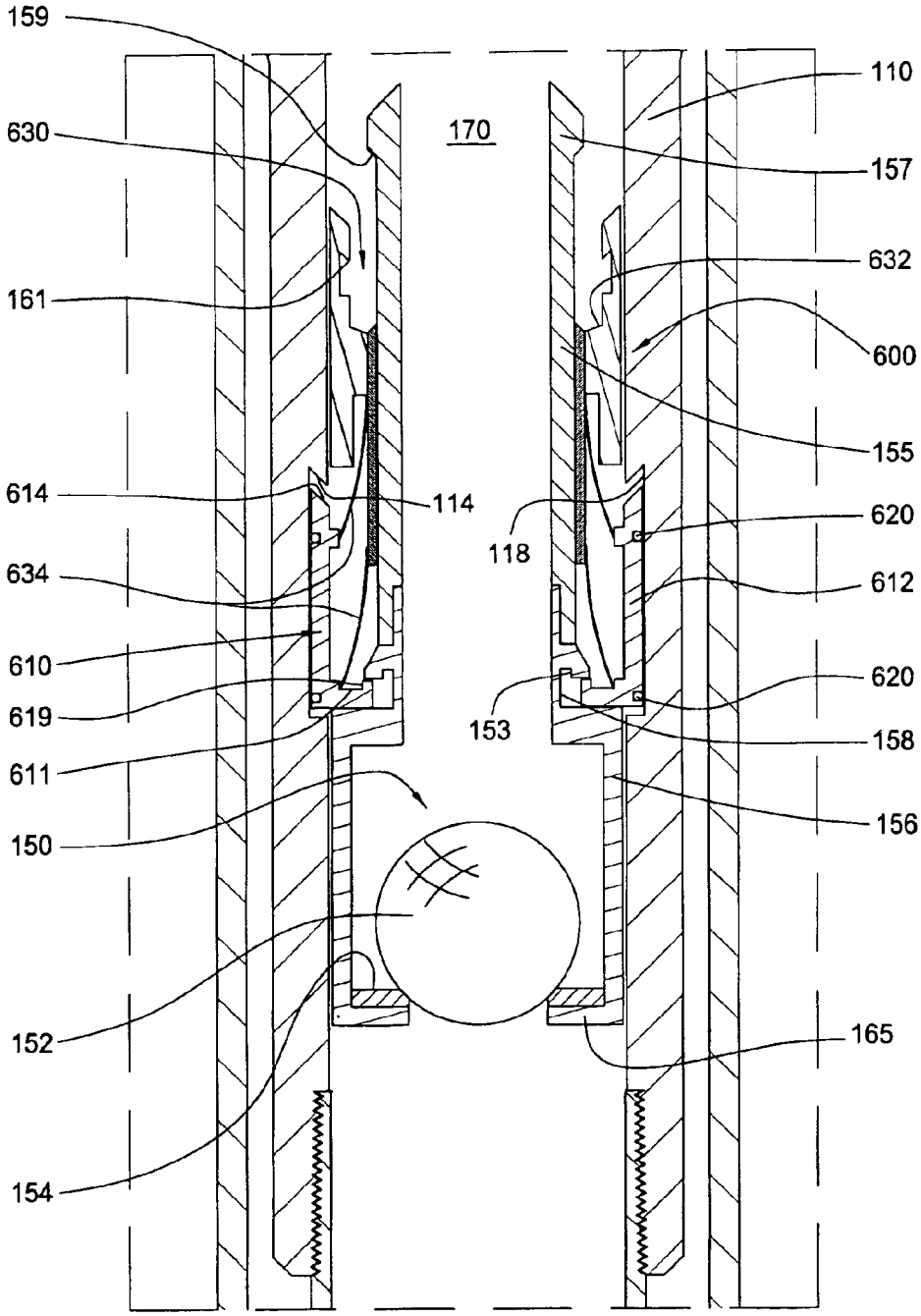
FIG. 4 presents an enlarged view of the lower valve of the pump of FIG. 2, including a novel latching assembly for selectively latching and unlatching the lower valve from the pump.

The inlet port housing 156 is selectively latched to and unlatched from the stator housing 110 by means of a novel latching assembly 600. FIG. 4 presents an enlarged view of the lower valve 150 of the pump of FIG. 2, including the latching assembly 600. The latching assembly 600 and attached standing valve 150 are lowered into the stator housing 110 by a running tool on the end of a wireline or coiled tubing oilfield service apparatus (not shown). When the latching assembly 600 and standing valve 150 are in the correct position within the stator housing 110, the latching assembly 600 is engaged, locking the latching assembly and attached standing valve 150 within the stator housing 110. The running tool (not shown) is detachably connected to the fishing neck 157 such that a heavy upward impact by the wireline or coiled tubing will cause a detent or a shear pin on the running tool to release the fishing neck 157. Once the latching mechanism 600 is engaged, the running tool is detached from the fishing neck 157 by an upward impact. The running tool is then withdrawn, leaving the standing valve 150 installed in the housing 110.

In one aspect, the latching assembly 600 utilizes a series of locking segments 610. The locking segments 610 define L-shaped members that are selectively moveable between internal recesses 118 within the pump housing 110, and outer recesses 158 within the inlet port housing 156. Thus, when the locking segments 610 are within the recess 158 of the inlet port housing 156, the inlet port housing 156 and connected standing valve 150 may be removed from the wellbore 10 by retrieving the inlet port 165. However, when the locking segments 610 are within the stator housing 118, the inlet port housing 156 and connected inlet port 165 may not be removed from the wellbore 10, but are held in place within the pump 100.

To accomplish the latching function, locking segments 610 are provided which ride in a retracted condition on the latching assembly 600 as it is lowered into the tubing 50 and pump housing 110 assembly. The vertical arm 612 of the locking segments 610 is urged outward against the inner wall of the pump housing 110 by leaf springs 634. The locking segments 610 also each have a horizontal arm 611. The horizontal arm 611 is configured to be received within the recess 158 of the inlet port housing 156. The end of the horizontal arm 611 includes a lip 619 which catches on a corresponding shoulder 153 within the inlet port housing 156. The lip 619 causes the lower portion of each locking segment 610 to remain in its retracted position. As long as the latching assembly 600 moves in a downward direction, the locking segments 610 remain in the retracted position. However, when the latching assembly 600 is moved upward, the vertical arm 612 catches on a tapered shoulder 114, allowing the locking segments 610 to deploy. This latches the latching assembly 600 into the pump housing 110. When the latching assembly 600 is pulled upward, the beveled edge 614, which is urged outward against the inner wall of the pump housing 110, catches on the tapered shoulder 114. The force of this engagement causes the lip 619 to slide off and disengage from the shoulder 153, at which point the locking segments 610 are forced outward by the leaf springs 634 into the recess 118 of the pump housing 110. The leaf springs 634 then continue to hold the locking segments 610 in the latched condition, locking the standing valve 150 in its operating position.

The locking segments 610 are biased in the unlatched position by weak biasing members 620. This means that the locking segments 610 are biased to be retracted into the recess 158 of the inlet port housing 156. However, retraction only occurs when the strong biasing force of the leaf springs 634 is removed. In the preferred embodiment, the biasing members 620 are springs circumferentially placed around the locking segments 610. These springs 620 are maintained in tension, and define lock segment retainer springs. However, other types of biasing members may be employed.

During pumping operations, the locking segments 610 are latched into the recess 118 of the pump housing 110 by the leaf springs 634. In order to overcome the bias imposed by the circumferential springs 620, a plurality of lock segment latching members 630 are provided. The lock segment latching members 630 act against each of the radial locking segments 610. In one aspect, and as shown in FIG. 4, the lock segment latching member 630 defines a tubular body 632 having a bore therein. The upper wall portion 155 of the inlet port housing 156 is received within the bore of the latching member body 630. Extending below the tubular body 632 is a plurality of leaf springs 634. The leaf springs 634 act outwardly against the locking segments 610, forcing them into the inlet port housing 156.

FIGS. 2 and 4 demonstrate the inlet port housing 156 in its set position. In this position, merely pulling on the fishing neck 157 of the inlet port housing 156 will not release the inlet port housing 156 and the connected standing valve 150, as the vertical arm 612 of the locking segments 610 is latched into the recess 118 of the pump housing 110. In order to release the locking segments 610 and to allow the lock segment retainer springs 620 to unlatch the locking segments 610 from the pump housing recesses 118, the lock segment leaf springs 634 must be lifted. Lifting the lock segment latching member 630 will cause the leaf springs 634 to clear the locking segments 610, allowing the locking segments 610 to pop out of the recesses 118 of the housing 110 and to move into the recesses 158 of the pump inlet housing 156. In this way, the locking segments 610 are unlatched, and the standing valve 150 can be removed from the tubing 50.

It will be noted that in order to pull on the lock segment latching members 630, the fishing tool (not shown),which is attached to a wireline or coiled tubing oilfield service rig, must act not only as an overshot, but also as a spear. The overshot portion catches the lock segment latching members 630. The tubular body 632 includes upsets 161 of a fishing neck for receiving a spear-type fishing tool. As the tubular body 632 is drawn upward by the fishing tool (not shown), the leaf springs 634 slide off of the locking segments 610, allowing them to retract into the recesses 158 of the pump inlet housing 156, under the influence of the biasing members 620. The tubular member 632 is withdrawn further up the wellbore 10, whereupon it contacts the shoulders 159 of fishing neck 157. Continued upward urging of the tubular body 632 then causes the entire latching assembly 600 to retract from the wellbore.

Figure 5:
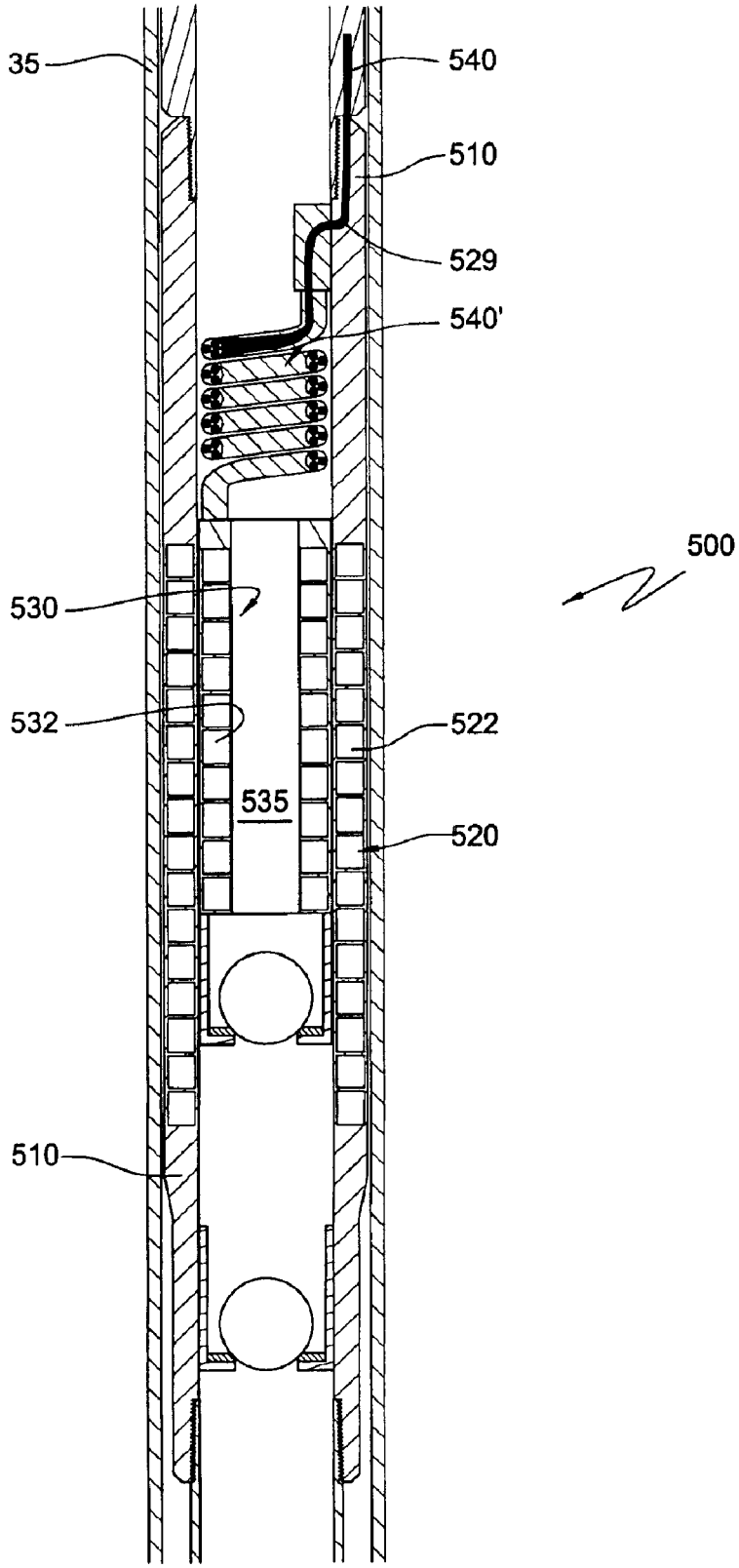
FIG. 5 is also a cross-sectional view of a positive displacement pump, but employing an alternative linear electric motor assembly.

An alternative embodiment of a submersible electrical pump 500 is provided in FIG. 5. In this arrangement, the armature 530 is again comprised of a plurality of armature modules 532. However, the armature modules 532 employ magnetic coils or induction coils (not shown), rather than permanent magnets. An alternating current is provided to the armature coils which is synchronous with that provided for stator coils within a plurality of stator modules 522. The resulting magnetic fields from the stator 520 and the armature 530 cause the armature 530 to reciprocate linearly.

A power cable (not shown) is provided for the electrical motor portion, i.e., the stator coils 522. For the stator 520, the power cable is typically a cable fixedly residing outside of the production tubing 50. Because the armature 530 for the submersible electrical pump 500 is also comprised of electrical coils, a power cable is also needed for the armature 530. Thus, a unique power cable is required which will allow the armature coils 534 to reciprocate. For the armature 530 depicted in FIG. 5, an armature cable 540 is provided. The armature cable 540 extends into the stator housing 510, and manifests as a spring 540'. The lower portion of the armature cable spring 540' is connected to the armature 530, and resides within the longitudinal axis of the bore of the production tubular member 50. The spring configuration allows the cable 540 to reciprocate lineally with the armature 530.

A preferred material for the cable spring 540' is an Inconel material. The Inconel spring 540' has at its core conductive wires that form the cable 540. In one embodiment, the wires pass through a through-opening 529 in a stator housing 510 where they then extend upward to the earth surface. Alternatively, a wet connect (not shown) may be employed to provide electrical communication between the armature cable 540 external to the housing 510, and the armature cable spring 440' within the housing 510. Alternatively, the cable 540 may simply extend to the earth's surface within the production tubing 50.

As shown in both FIG. 2 and FIG. 5, the stator housing 110, 510 for the respective submersible electrical pumps 100, 500 is threadedly connected to a production tubing 50 at its upper end. This allows for a larger stator bore. This, in turn, allows for a larger armature bore 135, 435. Finally, such a pump arrangement 100, 500 allows for novel well completion methods, as disclosed in more detail below.

Figure 6:
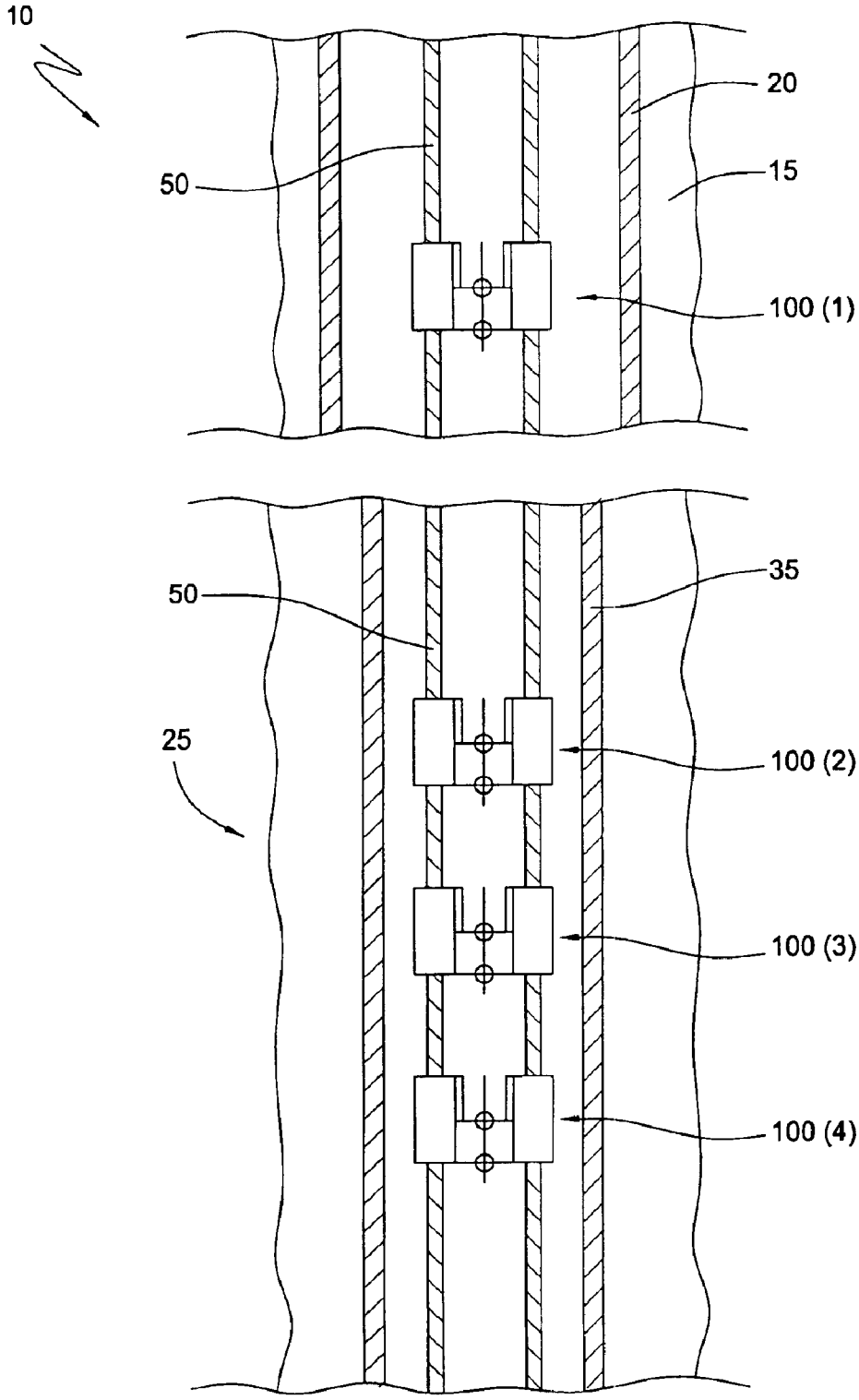
FIG. 6 is a schematic depicting a wellbore having a series of linear pump assemblies in accordance with one of the methods of completing a well of the present invention.

In operation, submersible electrical pumps of the present invention, such as pump 100, may be placed in series with the production tubing 50. In other words, more than one submersible electrical pump may now be employed in a well. For example, a series of linear electrical pumps 100(1), 100(2), etc. may be placed in different production zones of the wellbore 10. FIG. 6 depicts a schematic view showing a production tubing 50 employing a series of linear electrical pumps 100(1), 100(2), 100(3), 100(4) in fluid communication and in series with the production tubing 50. This allows for redundancy in completion design. In this respect, if one pump, e.g., 100(2) fails, other pumps, e.g., 100(1), 100(3), may be activated without replacing the failed pump 100(2).

The use of a plurality of submersible electrical pumps 100(1), 100(2), etc. in a production string 50 allows the operator to tailor the pumping capacity of a wellbore 10. If pressure in the formation 25 drops over the life of the well 10 such that additional pumping capacity is needed, an additional pump already in place downhole may be readily activated. Conversely, if it is desired to decrease pumping capacity, a downhole pump may be readily turned off.

It is further within the scope of the present invention to provide independent circuit protection for each pump 100 (1), 100(2), etc. In this manner, if one pump, e.g., 100(2) burns up or otherwise fails, any other pump, e.g., 100(3) operating at that time will not fail.

Figure 7:
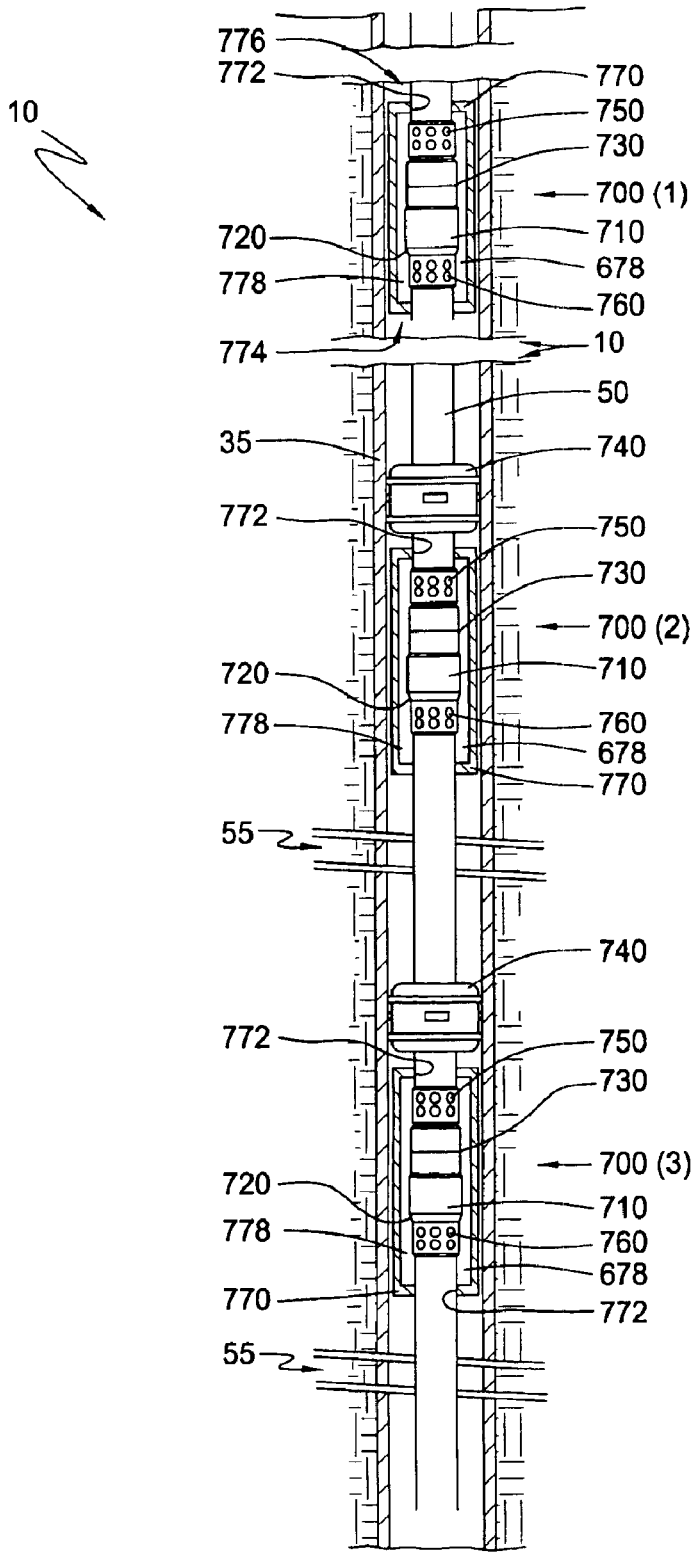
FIG. 7 is a partial sectional view of a wellbore having a series of rotary pump assemblies in accordance with one of the methods of completing a well of the present invention.

In another aspect for completing a well in accordance with the methods of the present invention, a series of rotary electrical pumps may be employed. FIG. 7 depicts a plurality of submersible electrical pumps 700(1), 700(2), 700(3) placed in series within a production tubing 50. Any number of pumps may be utilized. In the exemplary view of FIG. 7, three pumps 700(1), 700(2), 700(3) are in series with the production tubular member 50. The pumps 700(1), 700(2), 700(3) are strategically placed with respect to perforations 55 formed in the wellbore 10 in order to maximize production capacity and efficiency.

The submersible electrical pumps 700(1), 700(2), 700(3) in FIG. 7 utilize rotary electrical motors 710. The pumps 700(1), 700(2), 700(3) of FIG. 7 include outlet ports 760 below the electrical motors 710, and inlet ports 750 above the respective electrical motors 710. Around each of the outlet 760 and inlet 750 ports is a container 770 which serves as a fluid housing. Each container 770 has a lower opening 774 and an upper opening 776. The openings 774, 776 define radial through-openings for sealingly receiving the production tubular member 50. A container annulus 778 is defined between the container 770 and the respective rotary motors 710. The containers 770 allow production fluids to be diverted around the rotary motor 710 and transported up the tubing 50. Those skilled in the art will appreciate that fluid will not flow through a rotary motor. The containers 770 thus define a bypass annulus 678 through which fluid may flow around the respective rotary motors 710. Appropriate seals 772 are provided for the interface between each container 770 and the tubing 50.

The electrical pumps of FIG. 7 each include a blind coupling 720 and a motor seal section 730. These seals 720, 730 allow the rotary motor 710 to connect with the outlet 760 and inlet 750 ports without permitting fluid to flow through the motor. A packer 740 may also optionally be placed above any container 770, either to isolate separate production zones or to ensure that production fluids are diverted from the annulus between the tubing 50 and the casing 35 and up the tubing 50 itself.

The use of a rotary motor inside of a container is more fully disclosed in U.S. application Ser. No. 09/608,077, filed Jun. 30, 2000. That application, entitled "Isolation Container for a Downhole Electric Pump," is incorporated herein fully by reference. While the teachings of that application are primarily directed to a pump for injecting fluids, such as for fracturing a formation, the isolation container has application as a production pump. That application shows a container having an upper opening and a lower opening for fluidly sealing the production tubing. Container seals are provided for sealing the container from the production tubing.

In another aspect for completing a well in accordance with the methods of the present invention, a series of electrically driven pumps (such as pumps 700(1), 700(2), 700(3) in FIG. 7) is employed, with at least two of the pumps being separated by a packer (such as packer 740 shown in FIG. 7). The pumps may be linear pumps, rotary pumps, or a combination thereof. The linear pumps may be positive displacement pumps. The wellbore 10 is completed through more than one producing zone. In one arrangement, a first pump, e.g., pump 700(3) receives fluids from a first producing zone and pumps those fluids upwards towards the surface. A second pump, e.g., pump 700(2), receives production fluids from the first pump 700(3) as well as from a second producing zone. In another arrangement, the wellbore 10 is again completed through more than one zone. A first pump, e.g., pump 700(3) receives fluids from a first producing zone and pumps those fluids to a disposalzone. For example, the production fluids in the first producing zone could be primarily water, and the disposal zone could be at a depth in the wellbore 10 lower than the first producing zone. A second pump, e.g., pump 700(2), receives production fluids, e.g., primarily oil, from a second producing zone above the first producing zone, and pumps those fluids upwards to the surface. In either arrangement, any number of pumps may be utilized.

Figure 8:
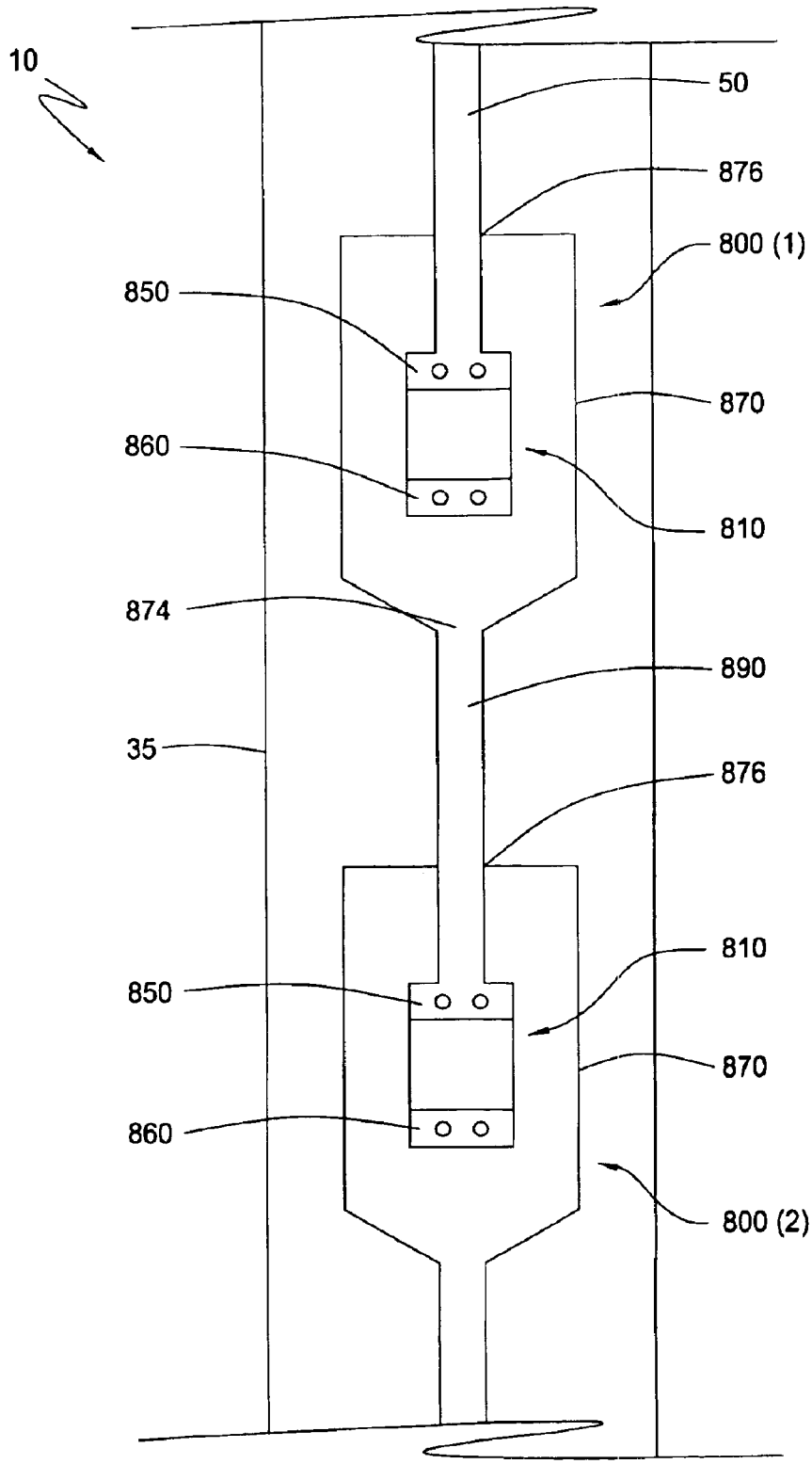
FIG. 8 is a schematic view of an alternative embodiment for placing a series of rotary pump assemblies in series with the production tubing per one of the methods of completing a well of the present invention.

An alternative embodiment for a rotary electrical motor arrangement and method for using a plurality of submersible electrical pumps in a wellbore completion is shown schematically in FIG. 8. In this embodiment, the packer may be removed. Further, the lower opening 874 of the container 870 forms a tubular member 890 in series with the production tubing 50. FIG. 8 presents two pumps 800(1), 800(2) connected to the tubing 50 in a wellbore 10. Each pump 800(1), 800(2) has a container 870. The containers 870 radially encompass the respective pumps 800(1). 800(2). The pumps employ rotary electrical motors 810. An upper opening 876 is formed at the top of each container 870. For the first pump 800(1), the upper opening 876 sealingly receives the production tubular member 50. However, for the second pump 800(2), the upper opening 876 sealingly receives the container tubular member 870.

Each electrical pump 800(1), etc., is configured in accordance with the pumps 700(1) of FIG. 7. In one respect, the pumps 800(1), etc. of FIG. 8 also comprise outlet ports 860 below the pumps 800(1), 800(2). The pumps 800(1), etc. of FIG. 8 also include inlet ports 850 above the motors 810.

One of the many novel uses of the submersible electrical pumps as disclosed herein pertains to the placement of an upper pump at a point in the production string which is above the production zone, and which is above the pump or pumps actually pumping production fluids at the production level or levels. As shown in FIGS. 7 and 8, an upper submersible electrical pump 700(1) or 800(1) operates independently from lower submersible electrical pumps 700(2), etc. or 800(2), etc. In this manner, the upper pump 700(1) or 800(1) is able to independently lift a portion of production fluids, thereby relieving lower pumps from the pressures applied by hydrostatic head. Those skilled in the art will recognize that where the tubing-casing annulus is devoid of fluid, lower portions of tubing 50 may exceed burst pressure when a substantial hydrostatic head exists. Use of an upper submersible electrical pump 700(1) or 800(1) of the present inventions allows for the completion of a well utilizing less expensive, lower-rated tubing 50.

In operation, production fluids enter the wellbore 10 through perforations (not shown in FIG. 8) in the casing 35. Production fluids then migrate into the bore of the production tubular member 50, either through the tailpipe (not shown) of the production tubing 50 or through perforation also placed in the tubing 50. Formation pressure, in some cases, is adequate to drive fluids up the tubing 50 to at least some extent. In many wells, however, force generated by turbines (not shown) within the motors 800(1), 800(2) is needed to drive the production fluids to the surface.

In the arrangement of FIG. 7, fluids reach the outlet ports 760 below the motors 700(1), etc. and then flow into the container annulus 778. In the arrangement of FIG. 8, fluids flow directly into the container annulus 878. In both arrangements, fluids bypass around the respective motors 700(1), 800(1), etc. and then flow into the inlet ports 750, 850 above the respective motors 700(1), 800(1). The turbines of the motors 700(1), etc. or 800(1), etc. then drive the production fluids to the surface. The result is that a plurality of submersible electrical pumps have been deployed in the wellbore 10.

It should also again be noted that the use of multiple submersible pumps includes the use of both rotary and linear pumps. Linear pumps, such as the novel pumps 100, 500 of FIGS. 2 and 5 may be used. Where rotary pumps are used, a container is needed, such as in the pump arrangements 700(1), 800(1) shown in FIGS. 7 and 8, respectively.

Figure 9:
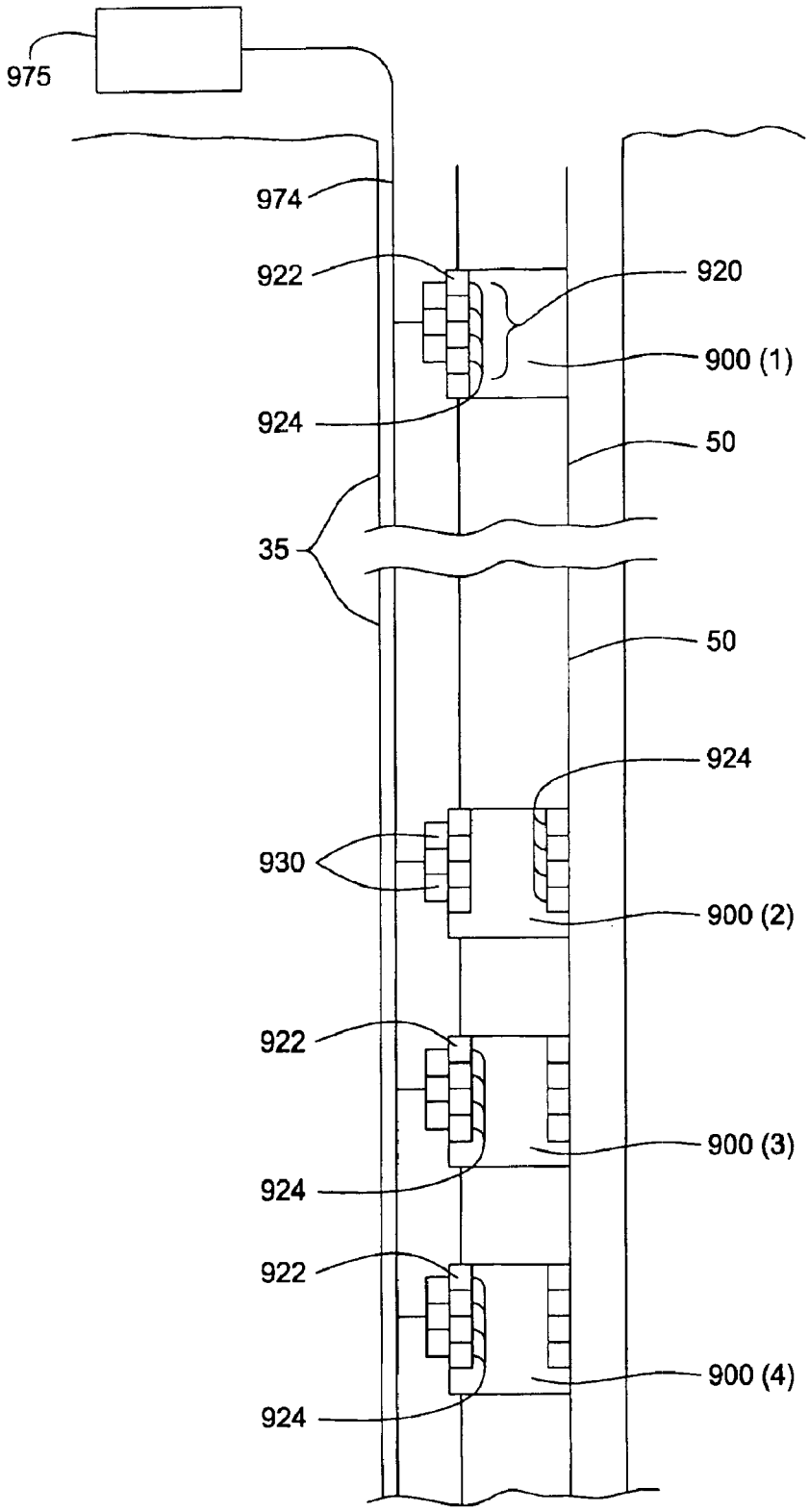
FIG. 9 is a schematic depicting the parallel circuitry wiring for a series of pump assemblies having a linear electrical motor in accordance with the present invention.

In another embodiment of the present invention, the coils, or windings, within the stator section of a linear electrical motor are wired in parallel, rather than in series. This provides an advantageous feature, as failure of one coil will not cause a failure of the entire electrical pump. FIG. 9 provides a schematic diagram showing the wiring of a submersible electrical pump 900 for the present invention, in parallel, so as to provide independent circuit protection for each coil 924. The scope of the present invention allows independent circuit protection by a fuse or other means, with wiring in parallel, for each individual coil 924, or for individual stator modules 922.

In another aspect, the coils 924 within the stators 920 of the present invention are powered via direct current, or DC current, rather than the known alternating current, or AC current. The use of DC current reduces line loss and related problems such as resonant frequency degradation. The reduction of line loss allows for less power to be directed from the surface, thereby reducing cost of operation. The oscillating field otherwise provided through AC power is obtained by a selectable switch downhole (not shown). The switch reciprocates the current between positive and negative settings at a desired frequency.

In yet another aspect, the coils 924 within the stators 920 of the present invention are selectively powered from the surface. This is done by wiring the coils in parallel, and then multiplexing their operation such that coils 924 are independently addressable. It is known to selectively address electronic components which have been configured in parallel. In one aspect, a controller 975 is employed at the surface for selectively activating coils 924 or stator modules 922. Three-box units 930 are shown to provide the parallel circuitry. In one aspect, the controller 975 is programmable.

In the present invention, separate signals may be issued from switches 975 at the surface to activate selected windings 924 or coil sections. This means that the windings 924 have independent on-and-off control. Where DC current is used, a small AC current is superimposed over one line in the DC current to enable control of the windings 924 from the surface. One advantage to being able to selectively activate coils 924 is that it gives the operator the ability to utilize only a portion of the coils within a submersible electrical pump 900. This, in turn, enables the operator to reduce the length of stroke of the pump. Stated another way, the use of only a portion of the coils will limit the linear movement of the armature, as the armature is acting in response to a shorter section of magnetic oscillation. Alternatively, if only a portion of coils containing a pump are used, this saves other coils to be used at a later time when the first-activated coils are worn, thereby extending the life of the pump. Alternatively, additional coils may be activated as formation pressure decreases over the life of the well.

The use of selective coil activation also has application with respect to separate submersible electrical pumps. In this respect, the operator may select which pumps to operate in a well at any given time. In one method for completing a hydrocarbon well, the operator chooses to operate less than all of the downhole pumps, while leaving remaining pumps dormant. When the initial pump or pumps ultimately suffer failure due to wear, the inactive pumps are then activated, thereby extending operation of the well before expensive intervention services are needed.

While the foregoing is directed to embodiments of the present invention, other and further embodiments of the invention may be devised without departing from the basic scope thereof, and the scope thereof is determined by the claims that follow.

What is claimed is:

1. An electrical pump for lifting fluids from a wellbore, the wellbore having a tubular member residing therein, the electrical pump comprising:

a stator;

an armature that linearly reciprocates relative to the stator;

a pump housing for housing the pump, the pump housing having a flow path therethrough;

wherein the pump is operatively connected to the armature and is reciprocated with the armature;

a traveling valve that reciprocates;

a standing valve that does not reciprocate; and wherein the pump is configured with multiple fishing necks to allow for the traveling valve and the standing valve to be separately retrievable from the wellbore.

2. The electrical pump of claim 1, wherein the pump is attached to the armature.

3. The electrical pump of claim 1, wherein the armature comprises a modular construction of armature modules.

4. The electrical pump of claim 3, wherein the armature modules are wired in parallel.

5. The electrical pump of claim 1, wherein the stator comprises a modular construction of stator modules.

6. The electrical pump of claim 5, wherein the stator modules are wired in parallel.

7. The electrical pump of claim 1, wherein the electrical pump is a positive displacement pump.

8. The electrical pump of claim 1, wherein the relative reciprocation is controlled by a controller.

9. The electrical pump of claim 8, wherein the controller controls at least a portion of the armature.

10. The electrical pump of claim 8, wherein the controller controls at least a portion of the stator.

11. The electrical pump of claim 8, wherein the controller is programmable.

12. The electrical pump of claim 1, wherein the flow path comprises an inner bore.

13. The electrical pump of claim 1, wherein:

the electrical pump is a positive displacement pump;

the armature comprises a modular construction of armature modules, the armature modules reciprocating together within the stator; and the stator comprises a modular construction of stator modules.

14. The electrical pump of claim 13, wherein the reciprocation of the armature modules is controlled by a controller.

15. The electrical pump of claim 5, wherein the pump housing comprises a stator housing for supporting the stator modules, the stator housing having a first end and a second end, the first end being connected to the tubular member.

16. The electrical pump of claim 3, wherein the pump housing comprises an armature housing for supporting the armature modules, the armature housing having a first end, a second end, and an inner bore therethrough.

17. The electrical pump of claim 16, further comprising:

a pump inlet connected to the stator housing proximal to the second end of the stator housing; and a pump outlet connected to the armature housing proximal to the second end of the armature housing, and being reciprocated by the armature housing.

18. An electrical pump for lifting fluids from a wellbore, the wellbore having a tubular member residing therein, the electrical pump comprising:

a stator;

an armature that linearly reciprocates relative to the stator;

an stator housing for supporting the stator, the stator housing having a first end and a second end, the first end being connected to the tubular member;

an armature housing for supporting the armature, the armature housing having a first end, a second end, and an inner bore therethrough;

a pump inlet connected to the stator housing proximal to the second end of the stator housing;

a pump outlet connected to the armature housing proximal to the second end of the armature housing, and being reciprocated by the armature housing; and wherein the pump is configured with multiple fishing necks to allow for the pump inlet and the pump outlet to be separately retrievable from the wellbore.

19. The electrical pump of claim 18, wherein the electrical pump is a positive displacement pump.

20. The electrical pump of claim 19, wherein:

the stator generates an oscillating magnetic field in response to direct current pulses that are cyclically switched in order to reverse polarity of the magnetic field; and the armature reciprocates within the stator in response to the oscillating magnetic field of the stator.

21. The electrical pump of claim 19, wherein:

the pump inlet comprises an inlet port housing, and a standing valve within the inlet port housing; and the pump outlet comprises an outlet port housing, and a traveling valve within the outlet port housing.

22. The electrical pump of claim 18, wherein the armature housing and the connected pump outlet may be removed from the tubular member without pulling the tubular member from the wellbore.

23. The electrical pump of claim 22, further comprising a fishing neck connected to the first end of the armature housing.

24. The electrical pump of claim 18, wherein the armature housing and the connected pump outlet may be removed from the tubular member without pulling the stator housing and the connected pump inlet from the wellbore.

25. The electrical pump of claim 18, wherein the pump inlet may be removed from the stator housing without removing the stator housing from the wellbore.

26. The electrical pump of claim 21, wherein the inlet port housing comprises an upper end having a fishing neck, and a second end housing the inlet port check valve.

27. The electrical pump of claim 25, wherein:

the stator generates an oscillating magnetic field in response to direct current pulses that are cyclically switched; and the armature reciprocates within the stator in response to the oscillating magnetic field of the stator.

28. The electrical pump of claim 26, further comprising a latching assembly for unlatching the inlet port housing from the stator housing, the latching assembly comprising:

a series of radially disposed locking segments, each locking segment having a vertical member and a horizontal member, the vertical member configured to be received within a locking segment recess within the stator housing when the locking segments are in their latched position, and the horizontal member configured to be received within an inlet port housing recess when the locking segments are in their unlatched position;

at least one unlatching biasing member around the locking segments to bias the locking segments in their unlatched position;

a lock segment latching member radially disposed about the inlet port housing intermediate the fishing neck of the inlet port housing and the lower end of the inlet port housing; and a plurality of lock segment biasing members radially connected to the lock segment latching member for biasing the locking segments outward in their latched position, the biasing force of the lock segment biasing members being greater than the biasing force of the unlatching biasing member.

29. The electrical pump of claim 28 wherein:

the lock segment latching member further comprises a fishing neck for receiving a spear on a fishing tool; and the plurality of lock segment biasing members release from the locking segments when the lock segment latching member is raised by a fishing tool.

30. The electrical pump of claim 20, wherein the stator defines a plurality of stator modules, each stator module comprising a series of coils for generating the oscillating magnetic field and a stator housing portion.

31. The electrical pump of claim 30, wherein each of the plurality of stator modules is electrically wired with a power source in parallel such that a failure of one of the stator modules does not produce a failure of another of the stator modules.

32. The electrical pump of claim 30, wherein each of the stator modules is multiplexed such that each of the stator modules is capable of being selectively activated.

33. The electrical pump of claim 31, wherein the armature defines a plurality of armature modules, each armature module comprising a series of magnets having a polarity and an armature housing portion, the polarities of the magnets being arranged to cause linear reciprocation of the armature modules and armature housing in response to the oscillating magnetic field of the stator coils.

34. An electrical pump for lifting fluids from a wellbore, the wellbore having a tubular member residing therein, and the tubular member having a fluid flow path therethrough, the electrical pump comprising:

an electric motor portion, the electric motor portion having a fluid flow path therethrough;

a pump portion operatively connected to the electric motor portion, the pump portion being in fluid communication with the fluid flow path of the tubular member and also being in fluid communication with the fluid flow path of the electric motor portion;

wherein the pump portion comprises a traveling valve and a standing valve, whereby the pump portion is configured with multiple fishing necks to allow the valves to be separately retrievable from the wellbore.

35. An electrical pump for lifting fluids from a wellbore, the wellbore having a tubular member residing therein, the electrical pump comprising:

a stator;

an armature that linearly reciprocates relative to the stator;

an stator housing for supporting the stator, the stator housing having a first end and a second end, the first end being connected to the tubular member;

an armature housing for supporting the armature, the armature housing having a first end, a second end, and an inner bore therethrough;

a pump inlet connected to the stator housing proximal to the second end of the stator housing;

a pump outlet connected to the armature housing proximal to the second end of the armature housing, and being reciprocated by the armature housing;

wherein the electrical pump is a positive displacement pump;

wherein the pump inlet comprises an inlet port housing, and a standing valve within the inlet port housing;

wherein the pump outlet comprises an outlet port housing, and a traveling valve within the outlet port housing;

wherein the inlet port housing comprises an upper end having a fishing neck, and a second end housing the inlet port check valve; and a latching assembly for unlatching the inlet port housing from the stator housing, the latching assembly comprising:

a series of radially disposed locking segments, each locking segment having a vertical member and a horizontal member, the vertical member configured to be received within a locking segment recess within the stator housing when the locking segments are in their latched position, and the horizontal member configured to be received within an inlet port housing recess when the locking segments are in their unlatched position;

at least one unlatching biasing member around the locking segments to bias the locking segments in their unlatched position;

a lock segment latching member radially disposed about the inlet port housing intermediate the fishing neck of the inlet port housing and the lower end of the inlet port housing; and a plurality of lock segment biasing members radially connected to the lock segment latching member for biasing the locking segments outward in their latched position, the biasing force of the lock segment biasing members being greater than the biasing force of the unlatching biasing member.

36. The electrical pump of claim 35 wherein:

the lock segment latching member further comprises a fishing neck for receiving a spear on a fishing tool; and the plurality of lock segment biasing members release from the locking segments when the lock segment latching member is raised by a fishing tool.

* * * * *